United States Patent [19]

Hemphill

[11] Patent Number: 4,930,906

[45] Date of Patent: Jun. 5, 1990

[54] COOKING GREASE DISPOSAL BAG

[76] Inventor: Fred S. Hemphill, 3587 Magnolia Ave., Lynwood, Calif. 90262

[21] Appl. No.: 396,056

[22] Filed: Aug. 21, 1989

[51] Int. Cl.[5] ..... B65D 30/02; B65D 30/16

[52] U.S. Cl. ..... 383/89; 383/104; 383/109; 383/113; 229/3.5 MF

[58] Field of Search ..... 383/89, 104, 109, 113, 383/110; 229/3.5 MF

[56] References Cited

U.S. PATENT DOCUMENTS

| | | | |
|---|---|---|---|
| 1,885,670 | 11/1932 | Avery | 383/113 |
| 2,162,258 | 6/1939 | Hultin . | |
| 2,481,380 | 9/1949 | Anderson, Sr. | 229/3.5 MF |
| 2,516,978 | 8/1950 | Gottesman . | |
| 3,149,771 | 9/1964 | Pearl | 383/89 |
| 3,239,126 | 3/1966 | Arslanian | 229/3.5 MF |
| 3,358,903 | 12/1967 | De Stefano et al. . | |
| 3,415,440 | 12/1968 | Watters . | |
| 3,438,567 | 4/1969 | Bell, Jr. | 229/3.5 MF |
| 3,561,670 | 2/1971 | Segal | 229/3.5 MF X |
| 3,663,239 | 5/1972 | Rowe et al. | 229/3.5 MF X |
| 3,775,239 | 11/1973 | Snow | 383/113 X |
| 3,822,037 | 7/1974 | Long . | |
| 4,328,895 | 5/1982 | Jaeger | 383/109 X |
| 4,387,126 | 6/1983 | Rebholz | 383/113 X |
| 4,478,858 | 10/1984 | Baird et al. | 229/3.5 MF X |

FOREIGN PATENT DOCUMENTS

| | | | |
|---|---|---|---|
| 2362769 | 3/1978 | France | 383/109 |

*Primary Examiner*—Stephen Marcus
*Assistant Examiner*—Jes F. Pascua
*Attorney, Agent, or Firm*—Jerry T. Kearns

[57] ABSTRACT

A cooking grease disposal bag is formed with a multiply construction and has an internal layer of a heavy gage deformable aluminum foil, an intermediate layer formed by a puncture resistant polyethylene sheet, and an outer layer formed by an insulating paper material. First and second fold lines are designated by indicia on an external front wall of the bag. A permanent adhesive strip covered by a peel off layer is disposed across a top edge of the front wall and a pair of tacky adhesive strips each having exposed tacky adhesive surfaces have a first end secured adjacent a first fold line and a second free end. The tacky adhesive strips may be utilized to temporarily seal the bag, while the permanent adhesive strip may be utilized to permanently seal the bag for disposal.

6 Claims, 3 Drawing Sheets

COOKING GREASE DISPOSAL BAG

BACKGROUND OF THE INVENTION

1. Field of the Invention

The present invention relates to disposal bags, and more particularly pertains to a multi-ply disposal bag for disposing of cooking grease in a safe manner, without plugging drains and plumbing fixtures.

2. Description of the Prior Art

Various types of disposal bags are known in the prior art. A typical example of such a disposal bag is to be found in U.S. Pat. Ser. No. 2,162,258, which issued to O. Hultin on June 13, 1939. This patent discloses a metal foil lined paper bag comprising an outer paper bag having a metal foil liner which is adhesively secured to the outer paper bag. U.S. Pat. Ser. No. 2,516,978, which issued to H. Gottesman on Aug. 1, 1950, discloses a freezing and cooking bag having a parchment layer secured to a paper layer. U.S. Pat. Ser. No. 3,358,903, which issued to P. De Stefano et al on Dec. 19, 1967, discloses a paper bag having a leak-proof seam. U.S. Pat. Ser. No. 3,415,440, which issued to C. Watters on Dec. 10, 1968, discloses a decomposition resistant bag having a multi-ply construction formed by three nested plies of kraft paper. U.S. Pat. Ser. No. 3,822,037, which issued to D. Long on July 2, 1974, discloses a disposal bag for use with a trash compactor. The bag includes opposed paper sheets joined at the edges and at one end to form a flat bag. A liquid impervious casing extends over the joined ends of the sheets and comprises a length of low density polyethylene which is folded and then heat sealed along the edges.

While the above mentioned devices are directed to disposal bags, none of these devices disclose a cooking grease adapted for disposal of heated cooking grease which includes a multi-ply construction having an internal layer formed by a heavy gage aluminum foil, an intermediate layer formed bY a puncture resistance polyethylene sheet, and an external layer formed by a paper material. Additionally, none of the aforesaid devices disclose the use of permanent and temporary adhesive strips allowing a cooking grease disposal bag to be temporarily sealed between uses and permanently sealed for disposal. Inasmuch as the art is relatively crowded with respect to these various types of disposal bags, it can be appreciated that there is a continuing need for and interest in improvements to such disposal bags, and in this respect, the present invention addresses this need and interest.

SUMMARY OF THE INVENTION

In view of the foregoing disadvantages inherent in the known types of disposal bags now present in the prior art, the present invention provides an improved cooking grease disposal bag. As such, the general purpose of the present invention, which will be described subsequently in greater detail, is to provide a new and improved cooking grease disposal bag which has all the advantages of the prior art disposal bags and none of the disadvantages.

To attain this, a representative embodiment of the concepts of the present invention is illustrated in the drawings and makes use of a cooking grease disposal bag formed with a multi-ply construction and having an internal layer of a heavy gage deformable aluminum foil, an intermediate layer formed by a puncture resistant polyethylene sheet, and an outer layer formed by an insulating paper material. First and second fold lines are designated by indicia on an external front wall of the bag. A permanent adhesive strip covered by a peel off layer is disposed across a top edge of the front wall and a pair of tacky adhesive strips each having exposed tacky adhesive surfaces have a first end secured adjacent a first fold line and a second free end. The tacky adhesive strips may be utilized to temporarily seal the bag, while the permanent adhesive strip may be utilized to permanently seal the bag for disposal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially those who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cooking grease disposal bag which has all the advantages of the prior art disposal bags and none of the disadvantages.

It is another object of the present invention to provide a new and improved cooking grease disposal bag which may be easily and efficiently manufactured and marketed.

It is a further object of the present invention to provide a new and improved cooking grease disposal bag which is of a durable and reliable construction.

An even further object of the present invention is to provide a new and improved cooking grease disposal bag which is susceptible of a low cost of manufacture with regard to both materials and labor, and which accordingly is then susceptible of low prices of sale to the consuming public, thereby making such disposal bags economically available to the buying public.

Still yet another object of the present invention is to provide a new and improved cooking grease disposal bag which provides in the apparatuses and methods of the prior art some of the advantages thereof, while simultaneously overcoming some of the disadvantages normally associated therewith.

Still another object of the present invention is to provide a new and improved cooking grease disposal bag to allow the disposal of cooking grease in a safe manner, without plugging drain lines and plumbing fixtures.

Yet another object of the present invention is to provide a new and improved cooking grease disposal bag having a multi-ply construction with an internal layer formed by a heavy gage aluminum foil, an intermediate layer formed by a puncture resistant polyethylene sheet, and an external layer formed by an insulating paper material.

Even still another object of the present invention is to provide a new and improved cooking grease disposal bag including permanent and temporary tacky adhesive strips allowing the bag to be temporarily sealed between uses and permanently sealed prior to disposal.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
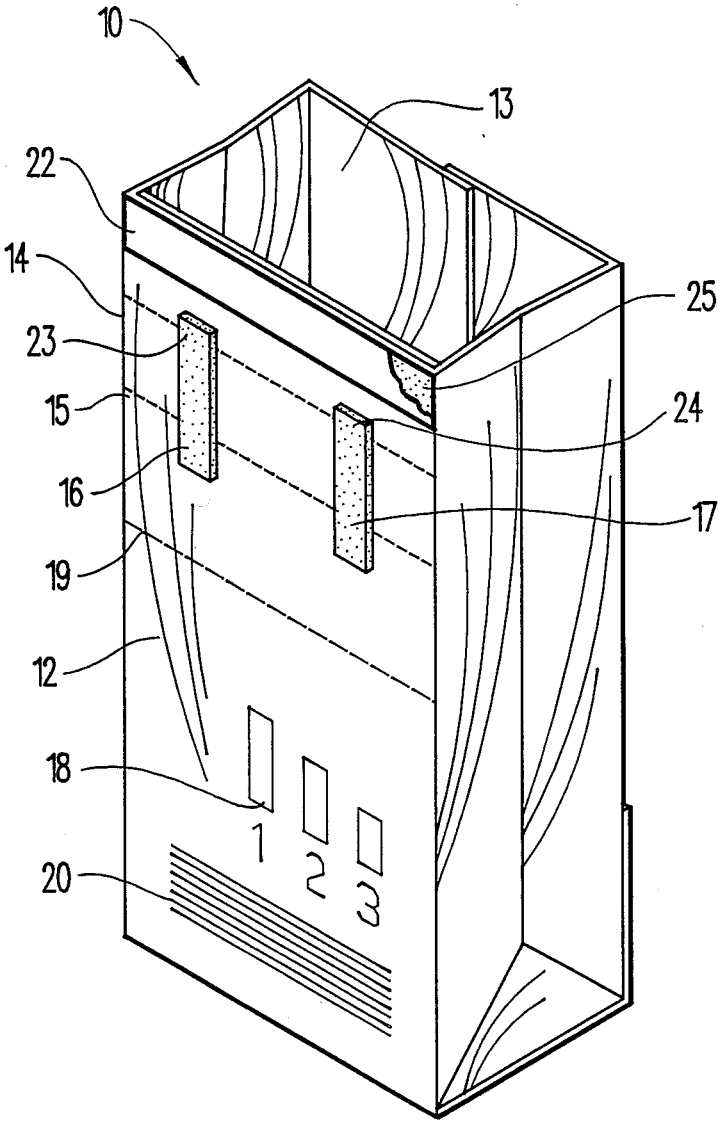
FIG. 1 is a perspective view of the disposal bag of the present invention in an open condition.

With reference now to the drawings, and in particular to FIG. 1 thereof, a new and improved cooking grease disposal bag embodying the principles and concepts of the present invention and generally designated by the reference numeral 10 will be described.

More specifically, it will be noted that the first embodiment 10 of the invention includes a generally rectangular bag having opposed front and back rectangular walls connected by spaced parallel rectangular side walls in a transverse bottom end wall. The bag has an open top end to allow cooking grease to be poured therein. The bag additionally has a multi-ply construction and includes an outer layer 12 formed by an insulating, relatively thick paper material, for example a kraft type paper. An internal layer of the bag is lined by a relativelY heavy gage aluminum foil layer 13. A first fold line 14 extends transversely across the exterior surface of the front wall of the bag 10. A second fold line 15 extends in parallel relation, below the first fold line 14. The first 14 and second 15 fold lines are preferably designated by a dotted line indicia on the exterior surface of the front wall of the bag 10. A first 16 and a second 17 tacky adhesive strips have respective end portions 23 and 24 permanently secured to the front exterior surface of the bag 10, adjacent the first fold line 14. The opposite ends of the strips 16 and 17 are free. A dotted line indicia 19 extends transversely across the front exterior wall of the bag 10, to indicate a maximum safe fill line, for filling the bag 10 with heated cooking grease. Graphic 18 and text 20 indicia is printed on the front surface of the bag 10, and provides instructions for temporarily and permanently sealing the bag 10. A peel off removable strip 22 covers a permanent adhesive strip 25, which extends across a top edge of the front exterior surface of the bag 10. The peel off strip 22 is partially cut away to illustrate the adhesive strip 25. In use, the bag 10 is utilized to store and dispose of heated cooking grease. After a cooking operation, hot grease is stored into the foil line interior of the bag 10, and the top of the bag is flattened to a closed position, as illustrated in FIG. 2.

Figure 2:
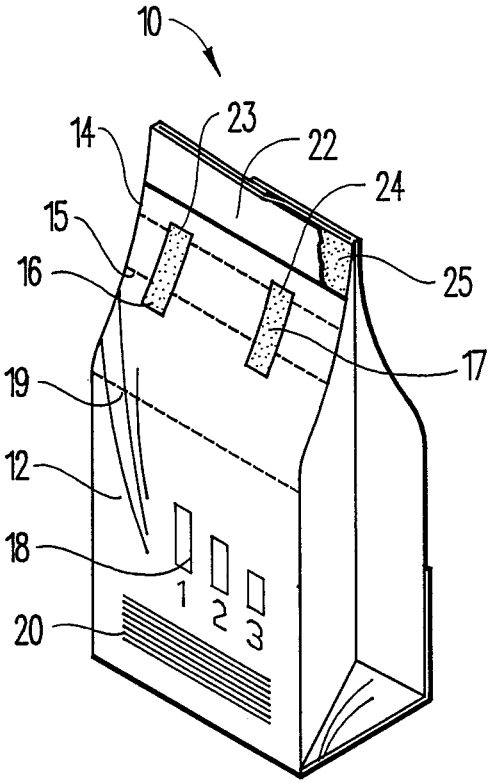
FIG. 2 is a perspective view of the disposal bag folded to a closed position.

As shown in FIG. 2, the bag 10 is pinched to a closed position, aided by the relatively heavy gage aluminum foil lining material. The outer insulating paper layer 12 protects an individual from being burned by the hot grease.

Figure 3:
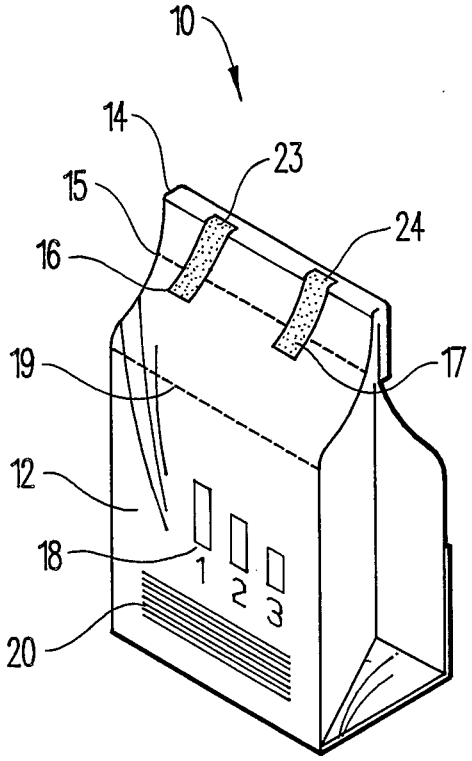
FIG. 3 is a perspective view of the disposal bag, in an intermediate closed folded condition.
Figure 4:
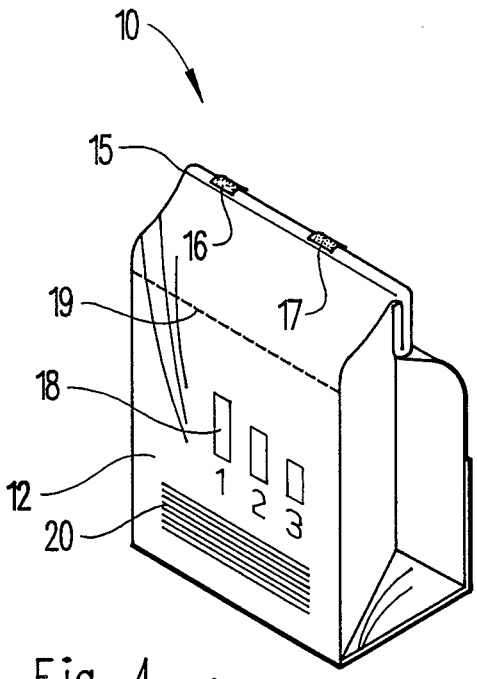
FIG. 4 is a perspective view of the disposal bag, folded to a temporary sealed condition.

As shown in FIG. 3, the top portion of the bag 10 is folded over along the first line 14, to a partially sealed condition. The bag is then again folded over along As shown in FIG. 4, the bag is then again folded over along the fold line 15, to the illustrated temporarily sealed condition. The tacky adhesive strip 16 and 17 may then be placed into engagement with the exterior back wall surface of the bag 10, to retain the bag 10 in the illustrated temporarily sealed condition. As previously described, the foil lining material is preferably of a sufficient thickness to assist in the sealing of the bag 10, through a crimping effect.

With reference to FIG. 2, it should be noted that the bag 10 may be permanently sealed by removing the peel off strip 22 and exposing the permanent adhesive strip 25. The top portion of the bag may then be folded toward the front surface of the bag, to permanently seal the bag prior to disposal.

Figure 5:
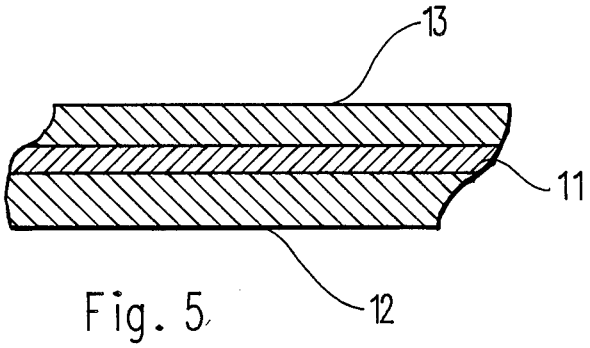
FIG. 5 is a cross sectional detail view illustrating the multi-ply construction of the disposal bag.

As shown in FIG. 5, the bag is preferably of a three-ply construction, and has an internal layer 13 formed by a relatively heavy gage aluminum foil material, an intermediate layer 11, preferably formed by a puncture resistant polyethylene sheet material, and an outer layer 12, formed from an insulating kraft type paper material. This multi-ply construction provides a leak proof receptacle for storing and disposing of cooking grease, and protects individuals from the spillage of hot cooking grease and from being burned by heat transfer through the walls of the bag.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A cooking grease disposal bag, comprising:

spaced parallel rectangular front and back walls connected by parallel spaced rectangular side walls and a rectangular bottom wall;

each of said walls being of a multi-ply construction having an internal layer of a heavy gage deformable aluminum foil, an intermediate layer formed by a puncture resistant plastic sheet, and an outer layer formed by an insulating paper material;

indicia on said front wall designating first and second spaced transverse fold lines;

and indicia on said front surface between said second fold line and said bottom wall designating a maximum fill line.

2. The cooking grease disposal bag of claim 1, wherein said intermediate layer is formed from a polyethylene material.

3. The cooking grease disposal bag of claim 1, further comprising indicia on said front wall indicating instructions for temporarily and permanently sealing said bag.

4. A cooking grease disposal bag, comprising:

spaced parallel rectangular front and back walls connected by parallel spaced rectangular side walls and a rectangular bottom wall;

each of said walls being of a multi-ply construction having an internal layer of a heavy gage deformable aluminum foil, an intermediate layer formed by a puncture resistant plastic sheet, and an outer layer formed by an insulating paper material;

indicia on said front wall designating first and second spaced transverse fold lines;

a permanent adhesive strip covered by a peel off layer disposed across a top edge of said front wall;

a pair of tacky adhesive strips having exposed tacky adhesive surfaces;

and each of said tacky adhesive strips having a first end secured adjacent said first fold line and a second free end, said tacky adhesive strips extending transverse to said permanent adhesive strip.

5. The cooking grease disposal bag of claim 4, further comprising indicia on said front wall indicating instructions for temporarily and permanently sealing said bag.

6. The cooking grease disposal bag of claim 4, wherein said intermediate layer is formed from a polyethylene material.

* * * * *